US005579934A

United States Patent [19]

Buono

[11] Patent Number: 5,579,934

[45] Date of Patent: Dec. 3, 1996

[54] CONVERTIBLE CHILD RESISTANT CLOSURE

[75] Inventor: Caetano Buono, Staten Island, N.Y.

[73] Assignee: Van Blarcom Closures, Inc., Brooklyn, N.Y.

[21] Appl. No.: 542,137

[22] Filed: Oct. 12, 1995

[51] Int. Cl.[6] ..... B65D 50/02

[52] U.S. Cl. ..... 215/220; 215/219

[58] Field of Search ..... 215/217, 219, 215/220, 221, 228, 274

[56] References Cited

U.S. PATENT DOCUMENTS

| | | | |
|---|---|---|---|
| 3,311,247 | 3/1967 | Rigor . | |
| 3,514,003 | 5/1970 | Fitzgerald . | |
| 3,828,958 | 8/1974 | Shannon . | |
| 4,011,960 | 3/1977 | Mauvernay et al. | 215/220 |
| 4,103,797 | 8/1978 | Morris | 215/209 |
| 4,172,533 | 10/1979 | Montgomery . | |
| 4,180,174 | 12/1979 | Quinn . | |
| 4,364,484 | 12/1982 | Kinsley . | |
| 4,366,921 | 1/1983 | Kirk, Jr. . | |
| 4,410,098 | 10/1983 | Dubs et al. . | |
| 4,433,789 | 2/1984 | Gibilisco | 215/220 |
| 5,092,477 | 3/1992 | Johnson, Jr. et al. . | |
| 5,115,929 | 5/1992 | Buono . | |
| 5,148,931 | 9/1992 | Minh . | |
| 5,246,123 | 9/1993 | Kramer et al. | 215/220 |
| 5,370,251 | 12/1994 | Buono . | |

*Primary Examiner*—Stephen K. Cronin
*Attorney, Agent, or Firm*—Cohen, Pontani, Lieberman, Pavane

[57] ABSTRACT

A convertible child resistant closure for use with a container having a threaded portion adjacent the container opening, e.g. the container neck, to allow a user to select between a child resistant closure and an easily openable closure depending upon the use and contents of the container. The closure includes coaxial inner and outer caps. The inner cap is defined by a cover wall and a side wall or skirt depending from the cover wall. The side wall includes an inner surface having a threaded portion for engagement with the threaded neck portion of the container, and an outer surface including a child resistant portion comprising a series of angular abutments extending thereabout and a non-child resistant portion axially offset from said child resistant portion and preferably in the form of a row of longitudinally extending knurlings. The outer cap is also defined by a cover wall and a side wall depending from the cover wall. The side wall includes an inner surface divided into a first child resistant portion and a second non-child resistant portion axially offset from the first portion. The first portion includes a plurality of angular abutment surfaces complementary to the series of angular abutments on the inner cap and the second portion includes a row of longitudinal knurlings complementary to the knurlings on the inner cap. The inner cap member is positioned within the second cap member and is axially movable between a first position in which the angular surfaces of the inner cap engage the angular abutment surfaces on the outer cap to provide a child resistant closure and a second position in which the knurlings on the outer surface of the inner cap engage the knurlings on the inner surface of the outer cap to provide a non-child resistant closure.

11 Claims, 5 Drawing Sheets

CONVERTIBLE CHILD RESISTANT CLOSURE

FIELD OF THE INVENTION

The present invention relates to the storage and dispensing of materials which may be harmful, particularly if improperly ingested and, more particularly, to a container closure that is selectively manipulable between a configuration which resists opening by children and a configuration which may be easily opened without special manipulation of the closure.

BACKGROUND OF THE INVENTION

Child resistant closures are well-known and understood to be effective in preventing inadvertent access to potentially dangerous materials such as medications by children. However, inclusion of the child resistant feature on containers is costly, and all too often, makes it difficult and frustrating for an adult user to open the container, especially an adult who has suffered a loss of manual dexterity, as by arthritis. Because of deteriorating health, elderly persons tend to rely on medication more than the average person. The elderly may also tend to have impaired manual strength and dexterity. Due to the difficulty encountered by such persons in opening child-resistant packages, many elderly persons request a non-child resistant substitute. Alternatively, when medications are purchased in child resistant packages by older adults, the packages are oftentimes not reclosed by the user thus defeating the purpose of the child resistant feature.

The aforementioned problems are generally recognized by the packaging industry, particularly in connection with packaging for the pharmaceutical industry. Attempts to deal with this problem are also disclosed in the patent literature. For example, U.S. Pat. No. 3,514,003 granted to Fitzgerald on May 26, 1970 teaches a two-piece closure having a selectably engageable locking device which is engaged or disengaged by axial movement of a collar member relative to a cap member. The cap and collar members have respective sets of teeth which interlock when the collar member is moved axially upwardly into its uppermost position. The neck of the bottle also includes teeth which engage the collar member when the collar member is in the uppermost position, thus preventing rotation of the closure. To unlock the closure, the collar member is slid downward and out of engagement with the cap member. This closure visually reveals that the collar member may be moved out of engagement with the cap member. Accordingly, a child having sufficient strength to disengage the collar member may have sufficient intellect to defeat the interlocking engagement and remove the closure. Moreover, the disclosed closure arrangement is not readily adaptable to commonly available bottles and vials, such as those typically used by pharmacists for dispensing prescription medications.

Another attempt to overcome the aforementioned problem is disclosed by Do Le Minth in U.S. Pat. No. 5,148,931, granted Sep. 22, 1992, which teaches a two piece closure having two sets of axial channels on an inner cap and two sets of protrusions on an interior surface of an outer cap. The closure is opened by aligning the protrusions on the outer cap with the proper set of channels on the inner cap, pulling the outer cap up relative to the inner cap, and rotating the outer cap so as to interlock the outer and inner caps. Disadvantageously, the disclosed arrangement is mechanically complex, requiring the consumer to follow a lengthy procedure to return the closure to the child resistant state, if required. Moreover, the complicated closure structure is difficult and expensive to fabricate.

It is thus desirable to provide a closure device which is selectively convertible between a child resistant configuration and an easily openable configuration allowing the user to choose the type of closure dependent upon the particular situation and environment in which the container is used.

SUMMARY OF THE INVENTION

Accordingly, it is an object of the present invention to provide an improved child-resistant closure for a container that is selectively convertible between a first position which provides a resistance to opening by children and a second position which can readily be opened by adults, even adults having impaired manual dexterity in their fingers due to conditions such as arthritis, etc.

It is a further object to provide a closure for a container which can easily be converted at the point of packaging to provide either a child resistant configuration or an easy-to-open configuration, depending on the needs of the particular customer.

The present invention relates to a convertible child resistant closure for use with a container having a neck portion which allows a user to select between providing the container with a child resistant closure and an easily openable closure depending upon the use and contents of the container. The closure includes co-axial inner and outer caps. The inner cap is defined by a cover wall and a side wall or skirt depending from the cover wall. The side wall includes an inner surface engageable with the neck of the container, as by threads on the inner surface of the inner cap and on the neck of the container, and an outer surface including a child resistant portion comprising a series of angular abutments extending thereabout and a non-child resistant portion axially offset from said child resistant portion and preferably in the form of a row of longitudinally extending knurls.

The outer cap is also defined by a cover wall and a side wall or skirt depending from the cover wall. The side wall includes an inner surface divided into a first or child resistant region and a second or non-child resistant region. The first region includes a plurality of angular abutment surfaces complementary to the angular abutments on the inner cap and the second region is axially offset from the first and includes a row of longitudinal knurls complementary to the knurls on the inner cap. The inner cap is positioned within the outer cap and is axially movable between the first region in which the angular surfaces on the inner cap engage the angular abutment surfaces on the outer cap to provide a child resistant closure and the second region in which the knurls on the outer surface of the inner cap engage the knurls on the inner surface of the outer cap to provide a non-child resistant closure.

The inner surface of the outer cap is also provided with first and second inwardly directed, restrictive projections or lips, the first projection separating the first and second regions and the second projection defining a limit position of the second region. These projections define the range of relative movement between the inner and outer cap members when positioned on a container. Thus, the closure can not be readily converted from the child-resistant configuration to the easy-to-open configuration when sealingly positioned on the container.

The abutment surfaces of the outer cap skirt are complimentary to the angular abutments of the inner cap skirt so that when the outer cap is turned in one direction, a closing direction, the plurality of abutment surfaces and the angular abutments meet to cam the inner cap together with the outer cap whereby rotation of the outer cap in one direction also turns the inner cap to threadedly engage the inner cap on the container. When the outer cap is rotated in the opposite direction, the opening direction, in the absence of an axial force on the outer cap in the direction of the inner cap, the plurality of abutment surfaces ratchet over the angular abutments thereby preventing the rotation of the inner cap in response to rotation of the outer cap. By applying sufficient axial force to the outer cap toward the inner cap the plurality of abutment surfaces on the outer cap will be held in engagement with the angular abutments on the inner cap to impart rotation to the inner cap.

When the knurls on the lower end of each cap are aligned and in engagement, the closure is in the easy-to-open, non child-resistant configuration. When the outer cap is turned in one direction, the mating engagement of the knurls enables the outer cap to impart rotation to the inner cap in both the first and second directions. Accordingly, with minimal effort, the outer and inner cap members may be turned simultaneously in either direction of rotation.

With reference to the angular abutments at the upper end of the inner cap, each of the abutments further includes a sloped first surface and a substantially vertical second surface. The sloped first surface and the substantially vertical second surface meet to define an angle in the range of about 30° to 60° therebetween and preferably about 45°. As well, each of the plurality of abutment surfaces on the outer cap preferably define an angle with the vertical in the range of about 30° to about 60° and preferably about 50°.

Thus, in accordance with the invention, a novel closure positionable between a first child resistant position and a second non-child resistant position is provided. Accordingly, depending on whether the user desires to have the closure in a child resistant position or non-child resistant position, the inner cap member may be moved relative to the outer cap member.

The various features of novelty which characterize the invention are pointed out with particularity in the claims annexed to and forming a part of the disclosure. For a better understanding of the invention, its operating advantages, and specific objects attained by its use, reference should be made to the drawings and descriptive matter in which there are illustrated and described preferred embodiments of the invention.

BRIEF DESCRIPTION OF THE DRAWINGS

In the drawings, wherein like reference numerals identify similar elements throughout the several views.

DETAILED DESCRIPTION OF THE PRESENTLY PREFERRED EMBODIMENTS

Figure 1:
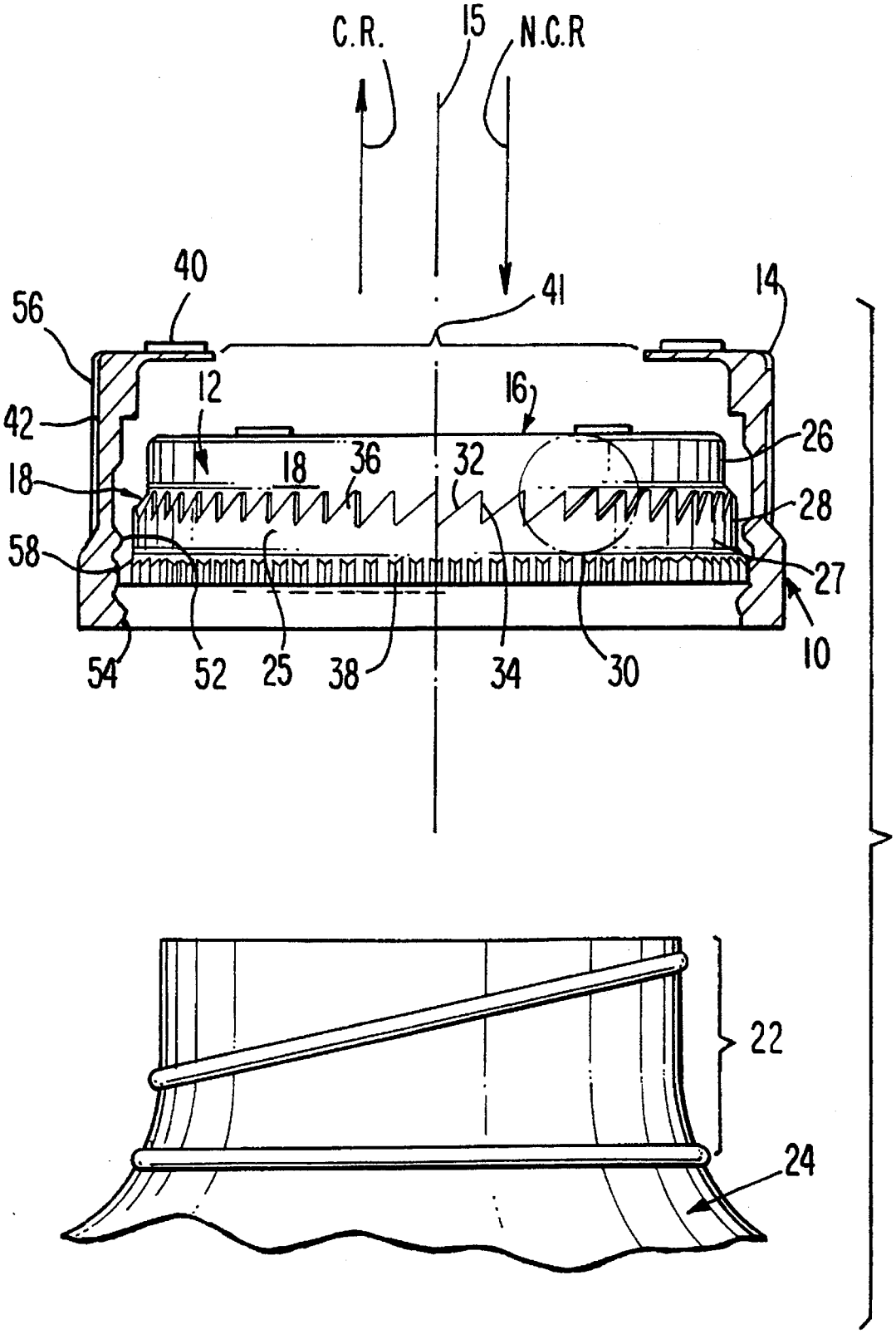
FIG. 1 is an exploded view, partly in side elevation and partly in cross section, of a child-resistant container and closure combination constructed in accordance with the present invention, the inner and outer cap members of the closure being relatively positioned to permit easy opening of a container by an adult.
Figure 2:
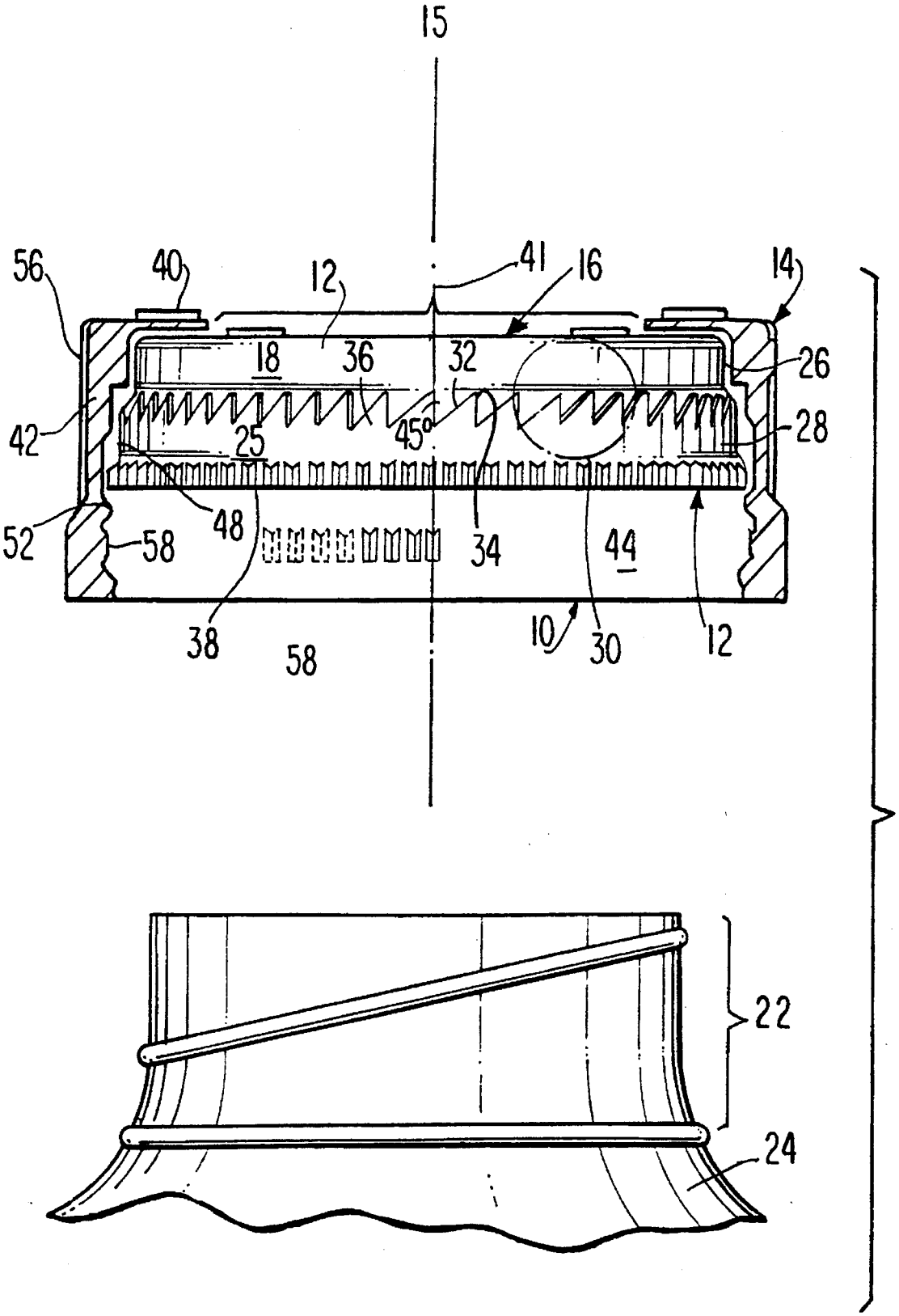
FIG. 2 is a view like FIG. 1 but with the inner and outer cap elements of the closure being relatively positioned to resist opening of a container by children.

FIGS. 1 and 2 show a closure in accordance with the present invention and labelled generally with the reference numeral 10 which includes an inner cap 12 and an outer cap 14. The closure 10 is constructed for use with a container 24 having a threaded neck portion 22 and is primarily directed for use with containers which store and dispense pharmaceutical products and the like but may also be used with any container having a threaded neck portion, irrespective of its contents. As will be described in greater detail later, when the caps 12 and 14 are axially aligned and nested one within the other, selected exterior portions of the inner cap 12 engage corresponding interior portions of the outer cap 14. For this purpose, the inner cap 12 has a circular upper or top wall 16 and a cylindrical side wall or skirt 18 that depends therefrom and the outer cap 14 has a circular upper or top wall 40 and a side wall or skirt 42 (FIG. 1).

Figure 5:
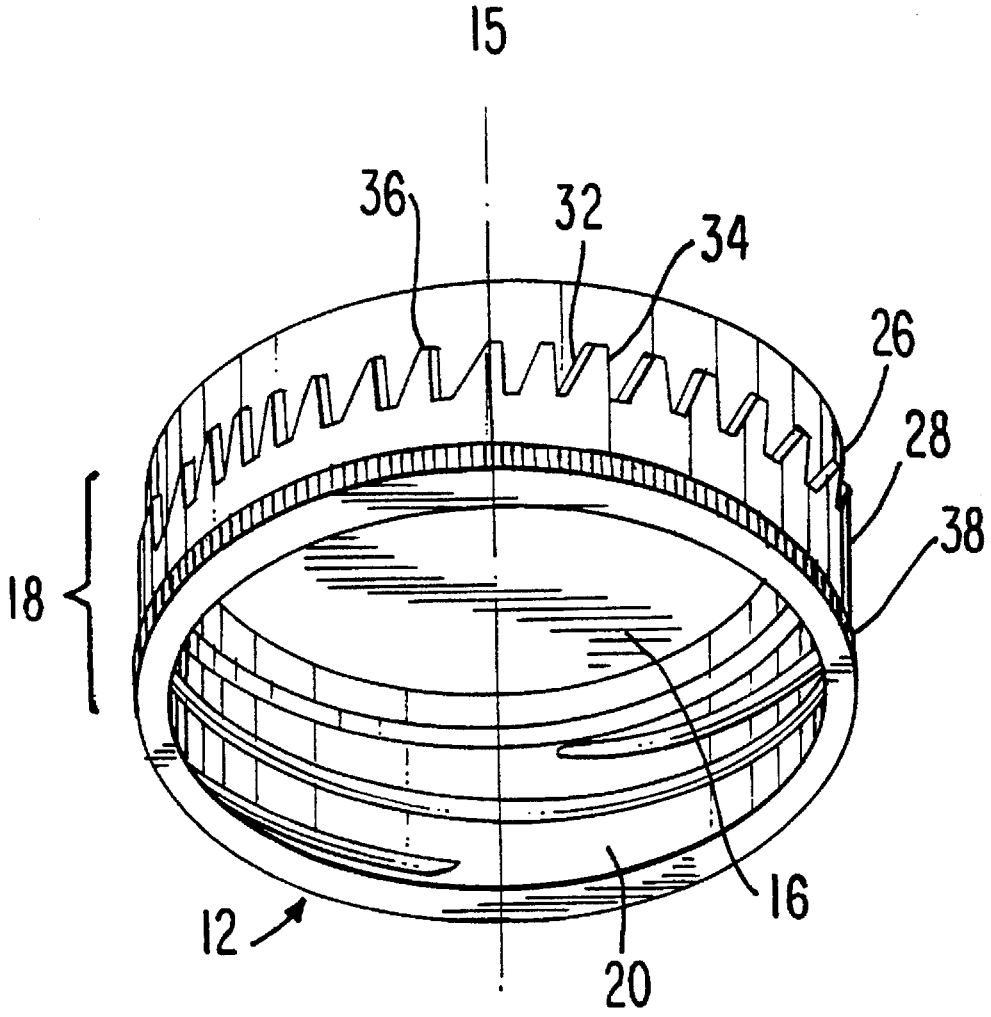
FIG. 5 is a bottom perspective view of the inner cap of the closure of FIGS. 1 and 2.

As best seen in FIG. 5, the inner cap 12 includes a cover wall 16 and a side wall or skirt 18 depending therefrom. The interior surface 20 of skirt 18 is threaded for mating engagement with the threaded exterior surface portion 22 of a container 24, as shown in FIGS. 1 and 2, when the inner cap 12 is rotated in a closing direction, here shown by way of example to be clockwise. Conversely, the inner cap 12 may be removed from the threaded portion 22 of container 24 by rotation of the former in an opening direction, e.g., counterclockwise.

Returning to FIG. 1, the exterior surface 26 of skirt 18 of inner cap 12 is provided with a radial shoulder 25 spaced from the cover wall 16 and extending outwardly from upper exterior surface portion 26 to define a radially outstanding lower skirt portion 28 on which is provided at or near the bottom a series of outwardly projecting teeth as by vertical knurlings 38 which extend outwardly from lower skirt portion 28. In the illustrative embodiment depicted in FIGS. 1, 2, 4 and 5, the radial shoulder 25 is preferably saw toothed as at 30, each saw tooth having a first sloped surface 32 and a second substantially vertical surface 34. The sloped first surface 32 and the substantially vertical second surface 34 define an angle preferably ranging from about 30° to about 60° therebetween, and most preferably about 45°. There are preferably thirty-two (32) individual triangular teeth 36 distributed about the radial shoulder 25 of inner cap 12, although, clearly, other numbers of teeth may be employed. The lower skirt portion 28, as already noted, is also provided with vertical knurls 38 which are located adjacent and extend about the circumference of the bottom of the lower skirt portion 28.

Figure 3:
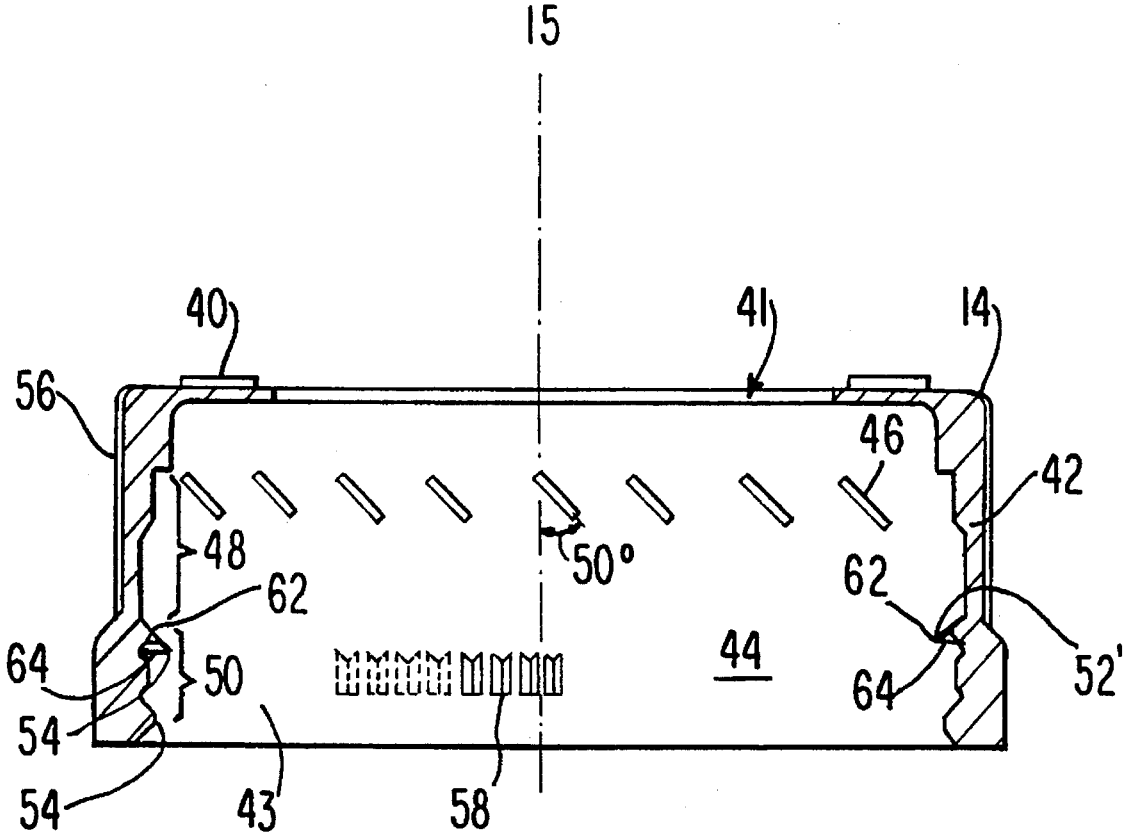
FIG. 3 is a cross sectional side view of the outer cap of the closure of FIGS. 1 and 2.
Figure 4:
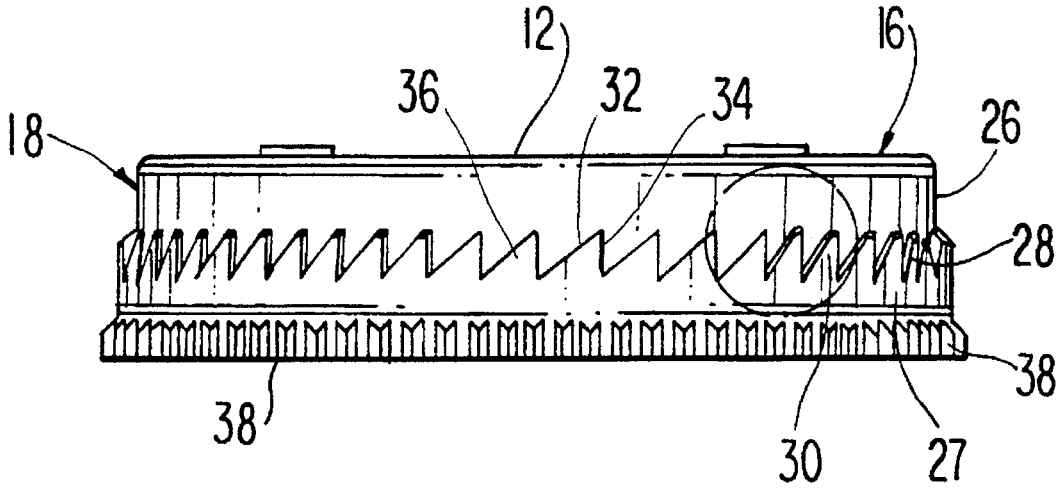
FIG. 4 is a side view of the inner cap of the closure of FIGS. 1 and 2 showing its exterior surface features.

The outer cap 14 has circular top wall portion 40 preferably with a central opening 41 as can best be seen from FIG. 3. The outer cap 14 also includes a cylindrical skirt 42 depending from the top wall 40. The inner cap 12 is nested within outer cap 14 so that the skirt 42 of outer cap 14 is coaxial with and peripherally surrounding the skirt 18 of inner cap 12. The outer cap 14 includes a first child resistant region 48 and a second non-child resistant region 50 as is shown in FIG. 3. An inwardly extending circumferential lip 52 is provided between the first or child resistant region 48 and the second or non-child resistant region 50. This lip 52 is preferably readily deformable or flexible, thus serving as a yieldable stop to releasably allow the inner cap 12 to pass over and hold the inner cap 12 in each of the two extreme positions shown respectively in FIGS. 1 and 2 while permitting the inner cap 12 to cause lip 52 to yield and permit the inner cap 12 to move from one position to the other when an axial force is applied. A second lip portion 54, which extends inward from near the bottom of skirt 42, is principally provided to define the limit of movement of the inner cap 12 into the second or non-child resistant region.

As shown in FIG. 3, the inner surface 44 of the skirt 42 of the outer cap 14 has a plurality of angularly extending abutment surfaces 46 positioned in the first or child resistant region 48. The embodiment shown in FIG. 3 has sixteen (16) such abutment surfaces 46 with the ratio of triangular teeth 36 to abutment surfaces 46 being two to one which is presently preferred. However, it is contemplated that any other suitable integral ratio of triangular teeth 36 to abutment surfaces 46, such, for example, as one to one, three to one, or the like may instead be used. The first and second regions 48, 50 may be reversed from the positions depicted in the figures. In such an embodiment the knurlings 38 would be positioned proximate the cover wall 16 of the inner cap 12 and the saw teeth 30 would be spaced from a base of the skirt 14 with a circumferential rim positioned about the base of the skirt 14. The abutment surfaces 46 and knurlings 58 would be positioned on the outer cap to align with the saw teeth 30 and knurlings 38 of the inner cap 12 in the same manner described herein.

The angularly extending abutment surfaces 46 on the outer cap 14 are angled in the same direction as the angled surface 32 of the saw teeth 36 located on the inner cap 12. Indeed, similar to the angle defined by surfaces 32 and 34 of projections 30, the angle defined between each abutment surface 46 and the vertical or axial is in the range of about 30° to about 60° and preferably close to but not identical to the angle defined by surfaces 32 and 34, with a preferred angle of 50° as shown in FIG. 3. Thus, when the inner cap 12 is positioned in the first or child resistant region 48 of the outer cap 14, as shown in FIG. 2, and when the outer cap 14 is rotated in the opening direction, the abutment surfaces 46 will ratchet or ride up over the sloped surface 32 of the saw tooth projections 30, thereby permitting rotation of the outer cap 14 relative to the inner cap 12. This, however, can be overcome by the simultaneous application of an opening turning force and an axial force on the outer cap 14 toward the inner cap 12 to prevent the ratcheting of surfaces 46 over surfaces 32 and enable the outer cap 14 to impart rotation to the inner cap 12 so that the two rotate in unison.

The outer cap 14 also includes a plurality of vertical knurlings 58 positioned about the inner surface of the skirt 42 in the second or non-child resistant region 50. Knurlings 58 are complementary to and interfittable with the knurlings 38 on the outer surface of skirt 18 of inner cap 12. The shifting of position of the inner cap 12 relative to outer cap 14 to move it from the first or child resistant region 48 to the second or non-child resistant region 50 disengages saw teeth 30 from abutment surfaces 46 and moves knurlings 38 of the inner cap 12 into engagement with knurlings 58 of the outer cap 14. To do this, an axial force is preferably applied to the inner cap 12 through opening 41 in the top 40 of the outer cap 14, although this could also be accomplished by reaching upwardly from the bottom of closure 10, grasping inner cap 12 and moving it relative to outer cap 14. The second lip 54 prevents the inner cap 12 from moving past the second or non-child resistant region 50 and out of nesting relation with the outer cap 14. The outer cap 14 may also incorporate serrations 56 on the outer surface of the skirt 42 for ease in gripping and rotating the outer cap 14. The serrations 56 preferably extend vertically along the length of the skirt 42 and may be positioned about the entire circumference of the skirt 42, or alternatively, selected portions thereof.

Operation of the convertible child resistant closure 10 of the invention will now be described with a reference to FIGS. 1 and 2. When the inner cap 12 is located in the second or non-child resistant region 50 of the outer cap 14, it is held within this region 50 by the first lip 52 and second lip 54 as shown in FIG. 1. The closure 10 is then placed on the threaded portion 22 of the container 24 and a rotative force is used to turn the outer cap 14 in the closing, e.g. clockwise, direction. The complimentary circumferential knurlings 38 of the inner cap 12 and the knurlings 58 of the outer cap 14 are engaged in this position, causing the inner cap 12 to rotate with, e.g. to remain stationary relative to, the outer cap 14 when it is grasped and rotated. Thus, as the user rotates outer cap 14 to open or close the container, the rotative force on the outer cap is transmitted to the inner cap through the intermeshed knurlings 38 and 58 to rotate the inner cap 12 and thereby either break or establish a thread closure of the bottle 22.

In order to convert the child resistant closure 10 from the non-child resistant position as shown in FIG. 1 to the child resistant position as shown in FIG. 2, the user applies an upwards axial force to inner cap 12 relative to the top wall 40 of the outer cap 14 thus moving the inner cap 12 to a position above the first lip 52 of the outer cap 14 and into the child resistant region 48. In moving the inner cap 12 from the non-child resistant region 50 to the child resistant region 48, the user must exert a force of a magnitude large enough to overcome the retaining force of the first lip 52 which now serves to releasably secure the inner cap 12 in the child resistant region 48.

The lip 52 may be constructed and arranged to restrict the inner cap 12 from being moved into either the first or child resistant region 48 or the second or non-child resistant region 50. For example, and referring to a modified lip 52' as shown in FIG. 3, the lip 52' is provided with a downwardly extending surface 62 which permits the inner cap 12 to move from the child resistant region 48 to the non-child resistant region 50. This lip 52' is also provided with a substantially horizontal restriction surface 64, which limits or substantially prevents yielding or flexure of the lip 52' in the upward direction to thereby limit or prevent, as the designer may prefer, the movement of the inner cap 12 from the non-child resistant region 50 to the child resistant region 48. In this way, the closure 10 may be converted from a child resistant closure to a non-child resistant closure but not back to a child resistant closure. As is evident, depending on the positioning of the downwardly extending surface 62 and the restrictive surface 64, the closure 10 may be converted from a non-child resistant closure to a child resistant closure or from a child resistant closure to a non-child resistant closure.

In order to utilize the closure when in a child resistant position and referring to FIG. 2, the closure 10 is first placed on the threaded portion 22 of the container 24 by threadedly engaging threaded surface 20 on inner cap 12 with the threaded portion 22. A rotative force turns the outer cap 14 in the closing direction, here shown to be clockwise. The vertical surfaces 34 of the teeth 30 on the inner cap 12 and abutment surfaces 46 on the outer cap 14 interengage to cause the inner and outer caps to turn together, e.g. to cause the inner cap 12 to remain rotationally stationary relative to the outer cap 14, to close the container. Upon closing the container 24 further rotation of the closure 10 in the closing direction is prevented. Rotation of the closure 10 in the opposite direction will cause the abutment surfaces 46 of the outer cap 14 to ratchet or ride over the angled surface 32 of the teeth 30 of the inner cap 12. That is to say, the mere turning of the outer cap 14 in the opening direction will not rotate inner cap 12 in an opening direction because there is no transmission of torque from the outer to the inner cap as the abutment surfaces 46 ride over and slide by the angled surfaces 32.

In order to open the closed container 24 with closure 10 in a child resistant mode, the user must utilize both a rotative and an axial force. It is the axial force that prevents the abutment surfaces 46 of the outer cap 14 from ratcheting or riding up and over angled surface 32 of the inner cap 12. Thus, when the outer cap 14 is rotated in an opening direction, here counterclockwise, with the use of both rotational and axial force, the abutment surfaces 46 of the outer cap 14 are prevented from ratcheting over angled surfaces 32 but instead engage one another to transmit torque between abutments 46 and angled surfaces 32 to thereby rotate the inner cap 12 causing it to disengage from the threaded portion 22 of the container 24. Accordingly, the closure 10 is disengaged from the container 24 and the container is open.

Figure 6:
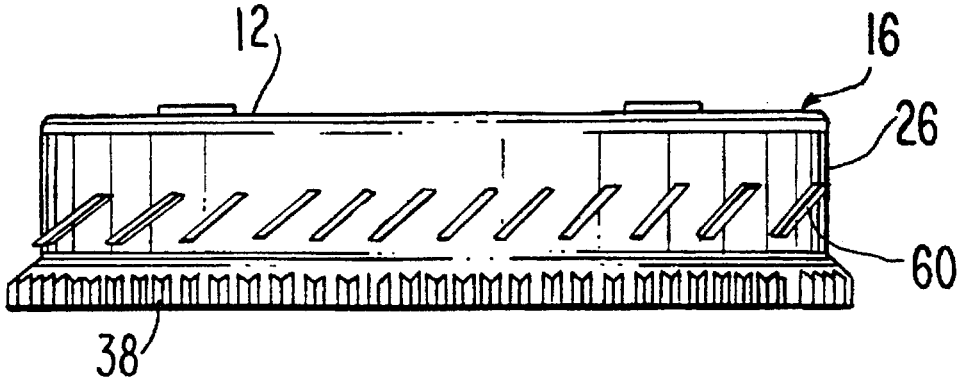
FIG. 6 is a side view similar to FIG. 4 depicting an alternate construction of the inner cap.

This is the presently preferred form for effecting the child resistant feature of the present invention. Of course, other means for drivingly connecting the inner and outer cap members relative to one another may be employed without departing from this invention. Referring to FIG. 6 an alternate form for the projections 30 is shown and labelled by the numeral 60. It is to be understood that any other suitable form for an abutment surface or projections may be utilized as long as upon engagement they perform the child resistant function necessary for this closure to properly operate. For example, and referring to FIGS. 3 and 6, two sets of abutment surfaces 46, 60 may be utilized instead of the abutment surface 46 and projection 30 combination as described with reference to FIGS. 1 and 2 to act as a clutch in order to transmit the counter-clockwise rotation of the outer cap member 14 to the inner cap member 12, whereby the inner cap member 12 and thus the closure 10 is disengaged from the container 24. Also, it will be apparent to anyone skilled in the art that by appropriately designing threaded surface 20 and threaded portion 22, and angling surfaces 32 and 46, the opening direction can be clockwise and the closing direction counterclockwise.

As shown and described, the containers which receive the various embodiments of closures incorporating the invention are provided with necks, e.g. narrowed inlets, having threaded portions 22 for threaded connection with the threaded surface 20 on inner surface of the inner caps 12. It will be apparent to those skilled in the art that the closures of the present invention do not require the threaded portion 22 to be on the neck of a container in order for the invention to operate. The same closures will operate equally satisfactorily with containers that do not have necks, so long as the portion surrounding the container inlet has a threaded portion 22 that is threadedly connectable with the threaded surface 20 on the inner cap 12. Thus, for example, the closures of the present invention will function well with a cylindrical container having a threaded surface 20 surrounding the outer wall surface in the area of the container opening.

It is to be understood that the convertible closure device provided in accordance with the present invention can be formed of any suitable material such as plastic or metal or a combination of materials and the like and that the invention is not intended to be limited by the material from which the devices are formed.

The invention is not limited by the embodiments described above which are presented as examples only but can be modified in various ways within the scope of protection defined by the appended patent claims.

I claim:

1. A convertible child resistant closure for use with a container having a threaded portion and an axis extending therethrough about which said closure is rotatable, said closure comprising:

an inner cap including:

a cover wall; and a circumferential side wall extending from said cover wall and having an inner surface with a threaded portion for engagement with the threaded portion of the container, and an outer surface including a child resistant portion comprising a series of angular abutments extending thereabout and a non-child resistant portion axially offset from said first child resistant portion and including a row of longitudinally extending knurlings; and an outer cap including:

a second cover wall; and a second circumferential side wall extending axially from said second cover wall and having a second inner surface provided with a second child resistant region including a plurality of angular abutment surfaces complementary to said series of angular abutments on said inner cap and a second non-child resistant region axially offset from said second child resistant region and including a second row of longitudinally extending knurlings complementary to said plurality of knurlings on said inner cap, said inner cap being coaxially positioned and nested within said outer cap and axially movable between said second child resistant region and said second non-child resistant region, and when in said second child resistant region said plurality of angular abutment surfaces engage said series of angular abutments upon rotation of said outer cap to rotate said inner cap in said closing direction and in the absence of an axial force, cam over and past said series of angular abutments upon rotation of said outer cap member in said opening direction to prevent rotation of said inner cap, and when in said second non-child resistant region said second row of knurlings are interengaged with said first row of knurlings so that upon rotation of said outer cap in both said opening and closing directions said inner cap turns.

2. The closure of claim 1, wherein said second inner surface further includes a first lip positioned between and said first and second regions for releasably inhibiting axial movement of said inner cap relative to said outer cap between said second child resistant region and said second non-child resistant region.

3. The closure of claim 1, wherein said outer cap includes a second outer side including a plurality of serrations extending along and positioned about said second outer side.

4. The closure of claim 1, wherein said second cover wall has a hole extending therethrough to expose said inner cap.

5. The closure of claim 4, wherein said hole is large enough to permit access therethrough to said inner cap.

6. The closure of claim 1, wherein said angular abutments of said series of angular abutments include a first sloped side and a second vertical side, said first sloped side and second vertical side defining a first angle in a range of about 30° to 60°.

7. The closure of claim 6, wherein said first angle is about 45°.

8. The closure of claim 6, wherein said second inner surface further includes a second lip positioned below said second region to define a limit of movement for said inner cap into said second region of said outer cap.

9. The closure of claim 6, wherein each of said plurality of angular abutment surfaces form a second angle with the axial in a range of about 30° to 60°.

10. The closure of claim 9, wherein said second angle is about 50°.

11. The closure of claim 9, wherein said first angle is substantially complementary but not equal to said second angle.

* * * * *